US009027207B2

(12) United States Patent
Lusher

(10) Patent No.: US 9,027,207 B2
(45) Date of Patent: May 12, 2015

(54) PAPER CLIPS WITH INTEGRAL FASTENER

(71) Applicant: Christopher Lusher, Louisville, KY (US)

(72) Inventor: Christopher Lusher, Louisville, KY (US)

( * ) Notice: Subject to any disclaimer, the term of this patent is extended or adjusted under 35 U.S.C. 154(b) by 0 days.

(21) Appl. No.: 13/987,143

(22) Filed: Jul. 3, 2013

(65) Prior Publication Data

US 2015/0007420 A1 Jan. 8, 2015

(51) Int. Cl.
*A44B 1/04* (2006.01)
*B42F 1/08* (2006.01)

(52) U.S. Cl.
CPC ... *B42F 1/08* (2013.01); *Y10S 24/10* (2013.01)

(58) Field of Classification Search
USPC ..... 24/67 R, 67.1, 67.3, 67.5, 67.7, 67.11, 24/67 CF, 67 P, DIG. 10
See application file for complete search history.

(56) References Cited

U.S. PATENT DOCUMENTS

| | | | | | |
|---|---|---|---|---|---|
| 586,003 | A | | 7/1897 | Bennett | |
| 742,892 | A | | 11/1903 | McGill | |
| 1,340,180 | A | * | 5/1920 | O'Brien | 24/67.9 |
| 1,369,717 | A | * | 2/1921 | Stark | 24/545 |
| 1,395,803 | A | | 11/1921 | Du Bois et al. | |
| 2,095,735 | A | | 10/1937 | Dunbar | |
| 2,269,649 | A | | 4/1941 | Comley | |
| 2,240,693 | A | | 5/1941 | Elnes | |
| 2,822,593 | A | | 2/1958 | Sponsel | |
| 3,633,253 | A | | 1/1972 | Ellis | |
| 3,975,921 | A | * | 8/1976 | Pomaski | 63/13 |
| 4,658,479 | A | | 4/1987 | Sanders | |
| D302,280 | S | | 7/1989 | Sanders | |
| 5,170,535 | A | * | 12/1992 | Strong | 24/67.9 |
| 5,319,835 | A | | 6/1994 | Chao | |
| 5,406,680 | A | * | 4/1995 | Silverberg | 24/67.9 |
| 5,481,784 | A | * | 1/1996 | Sinaiko | 24/67.9 |
| 5,655,266 | A | * | 8/1997 | Gish | 24/67.9 |
| D399,529 | S | | 10/1998 | Shyu | |
| 6,015,166 | A | | 1/2000 | May | |
| 7,434,343 | B2 | * | 10/2008 | Yoshida | 40/666 |
| 7,509,765 | B2 | | 3/2009 | Flores | |
| 8,024,844 | B2 | | 9/2011 | Aoto | |
| 2006/0048349 | A1 | | 3/2006 | Vercauteren | |
| 2007/0067966 | A1 | * | 3/2007 | Flores | 24/67.3 |
| 2007/0101552 | A1 | * | 5/2007 | Dolas | 24/67 R |
| 2009/0165260 | A1 | | 7/2009 | Tong et al. | |
| 2011/0088222 | A1 | | 4/2011 | Tsai | |
| 2011/0258813 | A1 | | 10/2011 | Lu | |
| 2012/0047698 | A1 | * | 3/2012 | O'Daniel | 24/67 R |

* cited by examiner

*Primary Examiner* — Robert J Sandy
*Assistant Examiner* — Matthew Sullivan
(74) *Attorney, Agent, or Firm* — Carrithers Law Office, PLLC

(57) ABSTRACT

A removable device for holding or clipping at least two pieces of paper, cardboard, plastic film or other sheets of material together. The paper clip includes a self biasing spring member for providing spring tension to hold an article to a flat substrate such as a piece of paper or papers and may include locking elements for removable engagement and holding of sheets of paper or the like together.

19 Claims, 7 Drawing Sheets

PAPER CLIPS WITH INTEGRAL FASTENER

TECHNICAL FIELD

The present invention relates to the field of clips primarily used to temporarily clasp two or more pieces of paper together.

BACKGROUND OF THE INVENTION

A paper clip is an instrument used to hold a number of sheets of material such as paper and/or film together or removably hold an article to one or more sheets. Paper clips are usually made of a polymer, steel wire, aluminum wire, or copper wire, plastic coated steel, aluminum, or copper wire having elasticity and exhibit torsion when bent to a looped shape. Most paper clips are characterized by the almost two full coplanar loops formed in the wire. When applying the clip to a paper stack, the inner loop is urged either forward or rearward of the outer loop thus creating a gap between the two wherein stacked pieces of paper are placed. The resulting torsion between to two loops tends to bias and return the two loops to a coplanar state, thus removably binding the sheets together. Friction between wire and paper also helps the prevent the sheets from sliding apart. Too many sheets will cause the elastic limit of the material to be exceeded, resulting in permanent deformation.

Commonly used paper clips comprise a length of wire bent to form two coplanar oval loops wherein a long oval loop is concentric with and inside a short oval loop. The oval loops include the longitudinal portions which are parallel to one another. The clips must be held open while paper sheets are inserted into them. The clips engage paper sheets in tension when the paper sheets are inserted forcibly between the loops which separate laterally. An inherent problem in this type of paper clip is the lack of sufficient gripping pressure between the separated wire loops. The gripping pressure is determined by the spring constant of the wire and the thickness of the paper sheets held within. Thicker sheets or more sheets will be held with more pressure than thinner sheets unless the number of sheets becomes too much to be reasonably held inside the paper clip. With even the stronger paper clips, sheets of paper are often likely to fall from a group when a strong enough force is applied which will tend to pull sheets out of the group. In other words, paper clips are often too weak to do the required task of holding pages together.

Paper clips usually have an oblong shape with straight sides, but may also be triangular or circular, or have more elaborate shapes. Moreover, the wire may include grooves, dimples, crimps, ridges, undulations, striations, or simply be smooth rectilinear sections.

Another commonly used method of holding a few sheets of paper together is dog-earring one corner of the pages together. This method is much less dependable than staples or paper clips due to the fact that friction between the pages within the dog-eared corners is the only force holding the pages together.

DESCRIPTION OF THE RELATED ART

U.S. Pat. No. 3,633,253 by Ellis for TWIST-TYPE SPRING CLIP which issued on Jan. 11, 1972 teaches a paper clip having a curved distal end which engages a distal end having a right angle distally extending "dog leg" which pierces the paper prior to providing a spring loaded clamp therewith.

U.S. Pat. No. 586,003 by Bennett for PAPER FASTENER which issued on Jul. 6, 1897 teaches a wire formed into a tri-lobed shape wherein the corner of a stack of papers is inserted between a first lobe and a portion of the wire form connecting the other two lobes. The first lobe is then urged against the corner of the stack, thus bending the stack and the first lobe over to cause the stack of papers to be 'dog-eared'. This causes the portion of the wire connecting the two lobes to be forcibly held inside the dog-eared papers, thus locking the papers together.

The GEM paper clip consists of a length of wire bent to form two coplanar oval loops wherein a long oval loop is concentric with and inside a short oval loop. The oval loops include the longitudinal portions which are parallel to one another; however, the paper clip does not include nor suggest a locking feature or means of releasably holding or retaining two or more sheets of paper together in a locked manner, wherein the clip is held into position when the paper is folded over in a dog-ear fashion.

SUMMARY OF THE INVENTION

In accordance with the present invention, a longitudinal member comprising a length of wire or other material having elasticity and torsion properties suitable to bias together a pair of coplanar oval loops including a long oval loop is concentric with and inside a short oval loop.

The oval loops include the longitudinal portions which are parallel to one another. In addition, the present invention includes a novel locking feature or means of releasably holding or retaining two or more sheets of paper together in a locked manner, wherein the clip is immovably held into position when the paper is folded over in a dog-ear fashion.

The paper clip of the present invention comprises, consists of, or consists essentially of a longitudinal member, for example, a length of a wire including the requisite elastic and torsion properties for bending to form two coplanar generally oval loops and more particularly concentric partial oval shapes including a first inner partial oval loop disposed within a second outer partial oval loop. The two partial oval loops are coplanar and biased one against the other. A second partial oval loop includes a first straight portion with a free end connected to a first 180° bend connected to a second straight portion connected to a second 180° bend. The first partial oval loop includes the second 180° bend connected to a third straight portion connected to a third 180° bend connected to a fourth straight portion. The fourth straight portion has a free end bent at a right angle which points outward from the first partial oval loop and upward from a plane of the coplanar partial oval loop shapes at an angle in the range of about 30° to about 60°.

It is an object of this invention to provide an improved paper clip which removably and securely locks sheets of paper together without piercing sheets as is done when using a staple.

It is an object of this invention to provide an improved paper clip which dependably holds as few as two sheets of paper together without piercing sheets as is done when using a staple.

It is an object of this invention to provide an improved paper clip which securely holds a number of pieces of paper together and which can be unlocked in order to add or remove papers and then re-locked.

It is an object of the present invention to provide a paper clip comprising a type of wire having a generally oblong shape with straight sides having a surface which may include grooves, dimples, crimps, ridges, or simply be smooth.

It is an object of this invention to provide an improved paper clip which securely holds a number of pieces of paper together and can be re-used.

It is an object of this invention to provide an improved paper clip and a method of use which securely holds a number of pieces of paper together and can be re-used. The method combines a new lockable paper clip and dog-earing the corner of the pages wherein a particular longitudinal portion of the paper clip is trapped inside the dog-ear and two layers of the pages comprising the dog-ear are clasped over and around the particular longitudinal portion, thus resulting a secure fastening of the pages.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided an improved paper clip including means for fastening for holding at least two sheets and typically a plurality of sheets or paper, plastic or other material together more securely when stacked and in the folded over position without requiring piercing of the sheets as required with the use of a stapler.

The paper clips of the present invention comprise a length of wire bent to form two generally coplanar oval loops wherein a short oval inner loop 34 is concentric with and disposed inside a longer outer oval loop 32. The oval loops include the longitudinal portions which are parallel to one another; however, it is contemplated that shape of the loops could be curved, circular, rectangular, triangular, or any desired shape so long as the inner loop 34 and outer loop 32 did not overlap and remained in close proximity to one another in order to provide the requisite torsional load and tension to hold one or more sheets of material therebetween.

Figure 1:
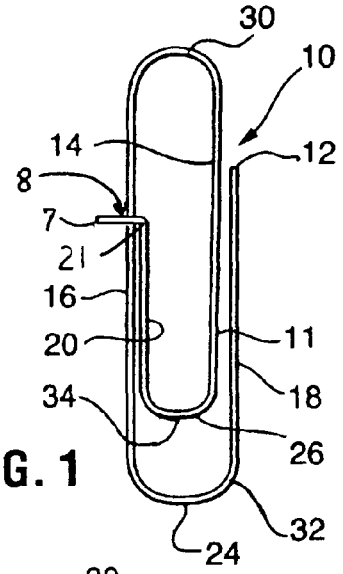
FIG. 1 is a front view of a first embodiment of the paper clip showing a projection providing a fastening means for cooperatively engaging a free distal end of the opposing leg.
Figure 2:
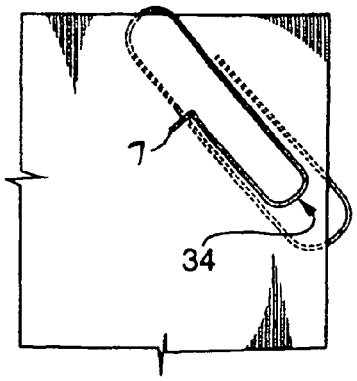
FIG. 2 is a perspective view of the embodiment of FIG. 1, showing the first step in applying the paper clip to a number of pieces of paper with the paper clip superimposed on a top sheet of paper wherein the sheet is slipped between the inner and outer loops of the paper clip with the portion of the paper clip covered by the paper shown in broken lines.
Figure 3:
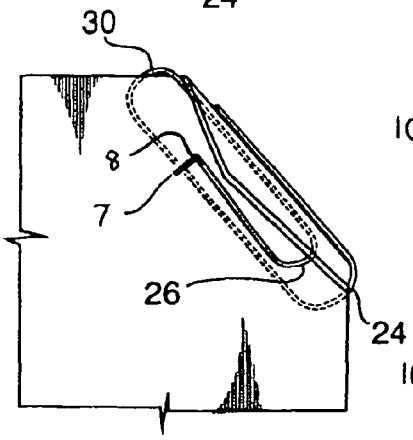
FIG. 3 is a perspective view of the embodiment of FIG. 1, showing the second step in applying the paper clip to a number of pieces of paper wherein the corner of the paper is folded upwardly between the outer leg 18 and inner leg 11.
Figure 4:
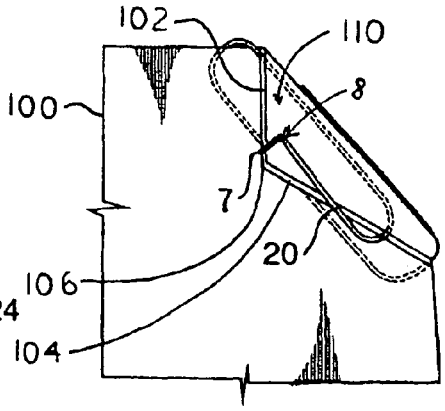
FIG. 4 is a perspective view of the embodiment of FIG. 1, showing the third step in applying the paper clip to a number of pieces of paper wherein the corner of the paper is slipped between the opposing inner leg 20 and opposing outer leg 16.
Figure 5:
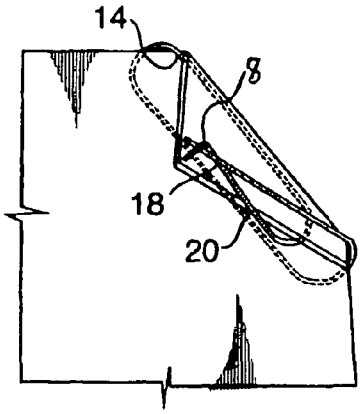
FIG. 5 is a perspective view of the embodiment of FIG. 1, showing the fourth step in applying the paper clip to a number of pieces of paper Wherein the distal end of leg 18 is biased inwardly cooperatively engaging the distal end of the opposing inner leg 20 removably securing the sheets of paper therebetween.

As shown in FIG. 1, the paper clip 10 comprises a longitudinal member such as a length of a spring material comprising a polymer, or metal such as copper, aluminum or steel, or plastic coated copper, steel, or aluminum having the requisite torsion and elastic properties to exhibit memory. The foregoing description will describe the embodiment using the term "wire" with reference to a longitudinal member comprising any of the materials of construction set forth heretofore.

A length of wire 11 is bent to form two partial oval loop shapes, a first inner oval loop 34 disposed within a second outer oval loop 32. The outer oval loop 32 is longer than the inner oval loop 34 which resides within the long partial oval loop 32. Further, in at least one preferred embodiment, the two partial oval loop shapes 32 and 34 are generally coplanar with one another.

As shown in the figures, the present invention includes features of a conventional GEM paper clip including a first length, section, or first leg 18 having a distal end 12 extending downward and curving upward in a 180 degree bend forming the outer bottom curved portion or partial oval loop 24 which extends upward spaced apart from and parallel to the first leg 18 forming the second outer leg 16 which extends upwardly a selected distance typically less than or equal to the distal end 12 of leg 18 and preferably a selected distance greater than the distal end of leg 18. The upper end portion of the second outer leg 16 curves inwardly toward leg 18 forming a 180 degree bend defining an outer top curved portion or partial oval loop 30 which extends downwardly to form a first inner leg 14 spaced apart from leg 18 parallel to and at a selected distance therefrom. Leg 14 usually lies along and sometimes touches the inside surface of leg 18. The first inner leg 14 extends downward a selected distance toward loop 24 and curves inwardly away from leg 18 and inside loop 24 toward leg 16 forming a 180 degree bottom inner curve or partial oval loop 26. A second inner leg 20 extends upwardly a selected distance and is spaced slightly apart from and parallel to, sometimes touching second outer leg 16. Leg 20 forms a distal end 7 which terminates at a point below the top curved portion 30.

The novelty in the instant invention lies in the modification of the distal end portion 7 of leg 20 to form a projection 8 or hook 22 for cooperative engagement with the distal end 12 of leg 18 providing a means of fastening the ends together and removably securing sheets of paper therebetween securing same even when the first sheet is folded behind the second sheet.

In a first preferred embodiment as best illustrated in FIGS. 1-7, the distal end portion 7 is bent at an acute angle forming a projection 8 extending at an angle of less than 180 degrees and more preferably at an angle up to 90 degrees and more preferably at an acute angle of up to 60 degrees, and more preferably up to 45 degrees, and most preferably in a range of from 30 to 60 degrees. As shown in FIGS. 1-7, the distal end 7 is bent at about a right angle 21. The projection 8 may be twisted and/or offset at a slight angle so that it is not coplanar with the legs 11, 18, and 16. The free distal straight end 12 of leg 18 is made of a spring type material with memory so that it can be temporarily bent at an angle to point outward from the long partial oval loop 32 so that the free end 12 is coplanar with the two partial oval loops 32 and 34. The distal end 12 of leg 18 is spring biased and the distal end 7 of inner leg 20 therein the distal end 12 cooperatively engages the projection 8 securing the corner of sheets therebetween even when the pages are folded over the paper clip.

Figure 6:
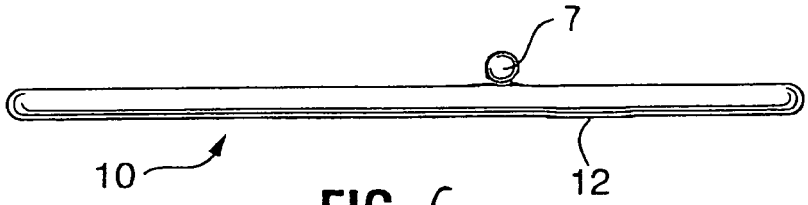
FIG. 6 is a side view of the paper clip of FIG. 1, showing distal end of the inner leg forming the projection.

The free end 12 of straight portion 20 is bent at a right angle pointing outward from partial oval loop 34 and, as shown in FIG. 6, extending upward from the plane containing partial oval loops 32 and 34. It will be seen that the free end 8 forms a projection which will be used to lock the paper clip by holding the longitudinal portion 18 over the dog-eared pages.

Figure 7:
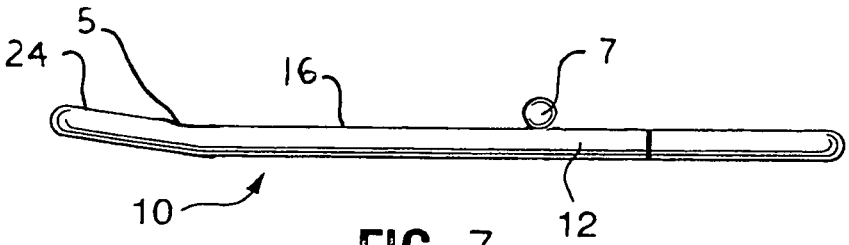
FIG. 7 is a side view of the paper clip of FIG. 1, showing distal end of the inner leg including the projection wherein the outer loop is bent slightly at an obtuse angle to facilitate sliding the sheets of paper between the outer loop and straight inner loop.
Figure 8:
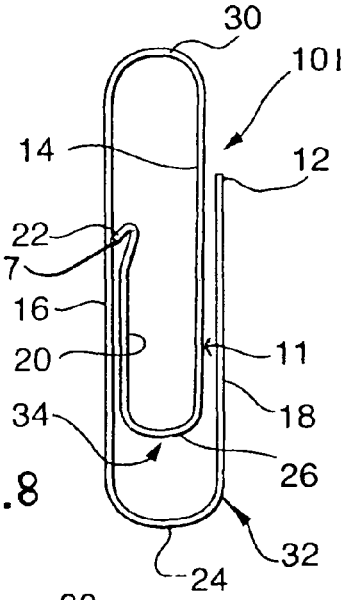
FIG. 8 is a front view of a second embodiment of the paper clip showing the projection modified to provide a hook providing a fastening means for cooperatively engaging a free distal end of the opposing leg.
Figure 9:
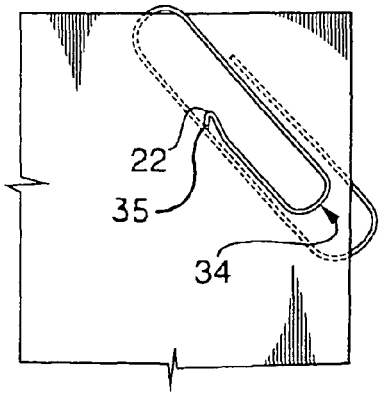
FIG. 9 is a perspective view of the embodiment of FIG. 8, showing the first step in applying the paper clip to a number of pieces of paper with the paper clip superimposed on a top sheet of paper wherein the sheet is slipped between the inner and outer loops of the paper clip with the portion of the paper clip covered by the paper shown in broken lines.
Figure 10:
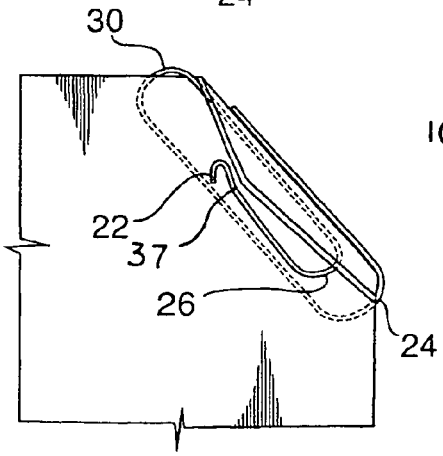
FIG. 10 is a perspective view of the embodiment of FIG. 8, showing the second step in applying the paper clip to a number of pieces of paper wherein the corner of the paper is folded upwardly between the outer leg 18 and inner leg 11.
Figure 11:
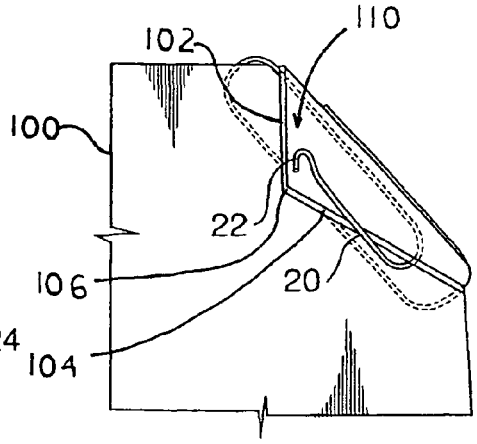
FIG. 11 is a perspective view of the embodiment of FIG. 8, showing the third step in applying the paper clip to a number of pieces of paper wherein the corner of the paper is slipped between the opposing inner leg 20 and opposing outer leg 16.
Figure 12:
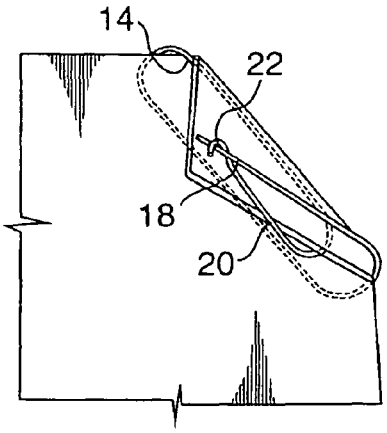
FIG. 12 is a perspective view of the embodiment of FIG. 8, showing the fourth step in applying the paper clip to a number of pieces of paper wherein the distal end of leg 18 is biased inwardly cooperatively engaging the distal end of the opposing inner leg 20 removably securing the sheets of paper therebetween;.

Moreover, as shown in FIG. 7, the outer bottom curved portion or partial oval loop 24 may be bent at a slight obtuse angle 5 of up to 179 degrees and preferably between 125 and 175 degrees with respect to the coplanar portions of the paper clip 10 comprising the upper portion of the legs 11, 16, and 18, bottom inner curve or partial oval loop 26, and outer top curved portion or partial oval loop 30 in order to facilitate sliding sheets in between the inner loop 34 and outer loop 32.

In another second preferred embodiment, FIGS. 8-15 show the free distal end 12 is bent at a selected angle 23 at a selected medial point forming a distal section 32 extending outwardly which can be pulled over to cooperatively engage hook 22 at angle 23 providing a stronger locking mechanism. The angled portion 32 of the leg 18 provides biasing means or tab for pulling the straight portion 18 into the hook 22 for locking purpose and also provides a more positive hooking action.

In the second embodiment, the distal end portion 7 is bent at an acute angle forming a hook 22 at an angle of less than 180 degrees and more preferably an angle of up to 90 degrees and more preferably at an acute angle of up to 60 degrees, and more preferably up to 45 degrees, typically in a range of from 30 to 60 degrees. As best shown in FIGS. 8-15, the distal end 7 is bent inwardly slightly at an obtuse angle 37. The hook 22 is twisted and/or offset at a slight angle so that it is not coplanar with the legs 11, 18, and 16. The wire is made of a spring type material with memory in order for legs 18 and 20 can be temporarily bent at an angle for cooperative engagement. As best illustrated in FIGS. 8-15, the distal end 112 of leg 18 is bent at a selected angle of less than 180 degrees and preferably as shown at an angle of about 90 degrees in order for the tip to point outward providing a second fastening member for more secure engagement with the hook 22. The distal end 12 of leg 18 is spring biased in close proximity to the hook 22 wherein the distal end 12 cooperatively engages the hook 22 securing the corner of sheets therebetween even when the pages are folded over the paper clip.

The free end 22 of straight portion 20 is bent at a right angle pointing outward from partial oval loop 34 and extending upward from the plane containing partial oval loops 32 and 34. It will be seen that the free end 22 forms a hook which will be used to fasten and/or lock the paper clip by holding the longitudinal portion 18 over the dog-eared pages.

Figure 15:
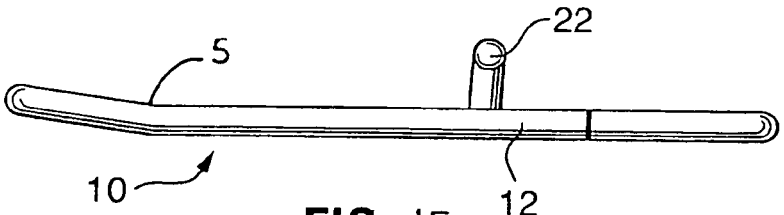
FIG. 15 is a side view of the paper clip of FIG. 8, showing distal end of the inner leg forming the hook member wherein the outer loop is bent slightly at an obtuse angle to facilitate sliding the sheets of paper between the outer loop and straight inner loop.
Figure 16:
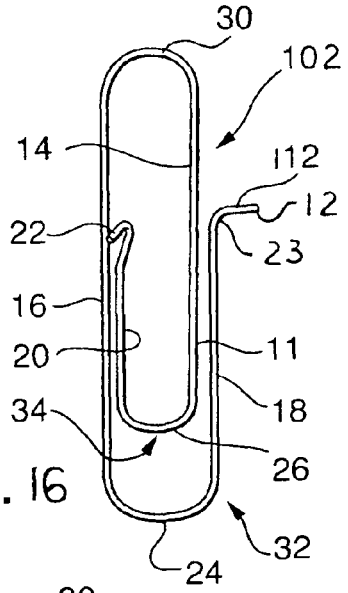
FIG. 16 is a front view of a third embodiment of the paper clip providing a fastening means defining a projection curved forming a hook for cooperatively engaging a free distal end of the leg of the outer loop which includes an outer loop distal leg projection means for cooperative engagement with the hook means formed on the free distal end of the leg of the inner loop.
Figure 17:
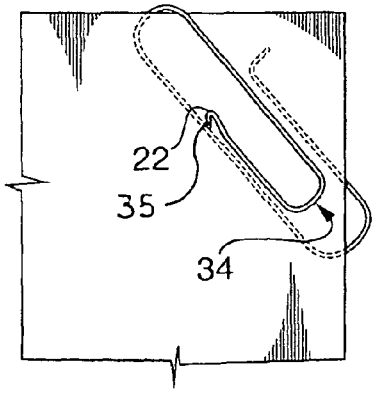
FIG. 17 is a perspective view of the embodiment of FIG. 16, showing the first step in applying the paper clip to a number of pieces of paper with the paper clip superimposed on a top sheet of paper wherein the sheet is slipped between the inner and outer loops of the paper clip with the portion of the paper clip covered by the paper shown in broken lines.
Figure 18:
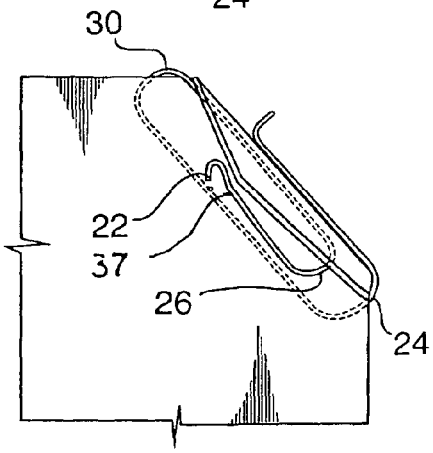
FIG. 18 is a perspective view of the embodiment of FIG. 16, showing the second step in applying the paper clip to a number of pieces of paper wherein the corner of the paper is folded upwardly between the outer leg 18 and inner leg 11.
Figure 19:
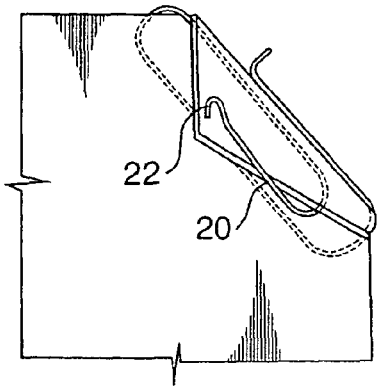
FIG. 19 is a perspective view of the embodiment of FIG. 16, showing the third step in applying the paper clip to a number of pieces of paper wherein the corner of the paper is slipped between the opposing inner leg 20 and opposing outer leg 16.
Figure 20:
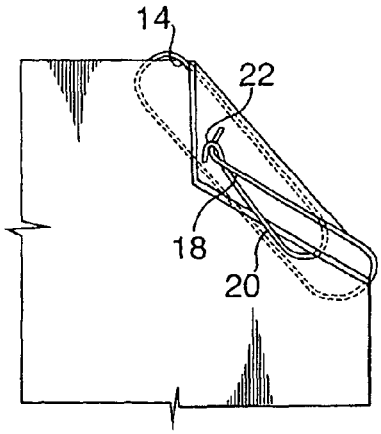
FIG. 20 is a perspective view of the embodiment of FIG. 16, showing the fourth step in applying the paper clip to a number of pieces of paper wherein the distal end of leg 18 is biased inwardly cooperatively engaging the distal end of the opposing inner leg 20 removably securing the sheets of paper therebetween;.
Figure 21:
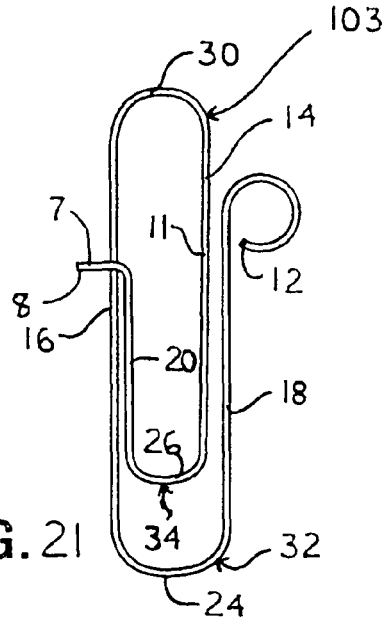
FIG. 21 is a front view of a fourth embodiment of the paper clip providing a fastening means for cooperatively engaging a free distal end of the leg of the outer loop including a projection means defining an angled distal end inner leg segment for cooperative engagement with tab means extending from the distal end of the leg forming the outer loop.
Figure 22:
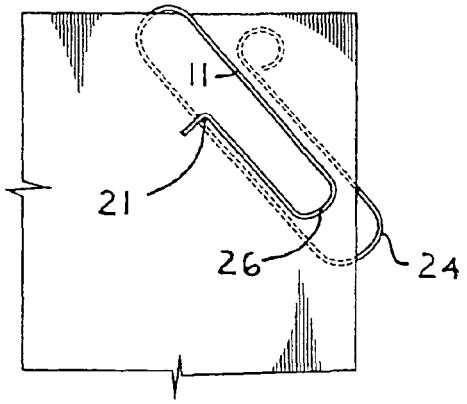
FIG. 22 is a perspective view of the embodiment of FIG. 21, showing the first step in applying the paper clip to a number of pieces of paper with the paper clip superimposed on a top sheet of paper wherein the sheet is slipped between the inner and outer loops of the paper clip with the portion of the paper clip covered by the paper shown in broken lines.
Figure 23:
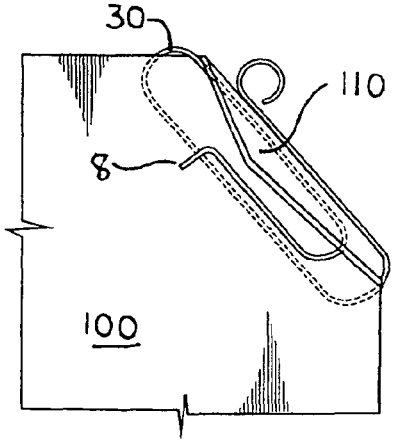
FIG. 23 is a perspective view of the embodiment of FIG. 21, showing the second step in applying the paper clip to a number of pieces of paper wherein the corner of the paper is folded upwardly between the outer leg 18 and inner leg 11.
Figure 24:
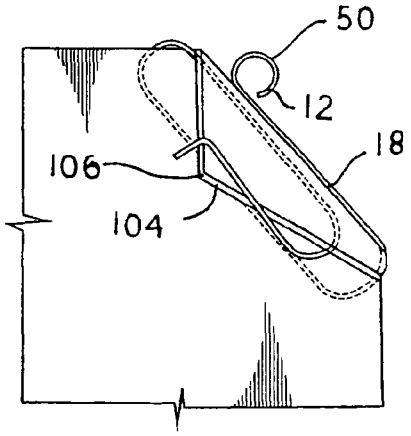
FIG. 24 is a perspective view of the embodiment of FIG. 21 showing the third step in applying the paper clip to a number of pieces of paper wherein the corner of the paper is slipped between the opposing inner leg 20 and opposing outer leg 16.
Figure 25:
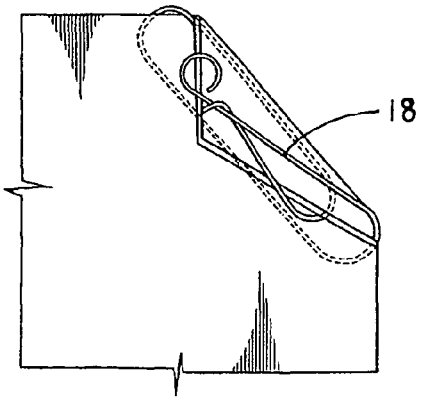
FIG. 25 is a perspective view of the embodiment of FIG. 21, showing the fourth step in applying the paper clip to a number of pieces of paper wherein the distal end of leg 18 is biased inwardly cooperatively engaging the distal end of the opposing inner leg 20 removably securing the sheets of paper therebetween.

Moreover, as shown in FIG. 15, the outer bottom curved portion or partial oval loop 24 may be bent at a slight obtuse angle 5 at upward or downward at slightly less than 180 degrees and preferably between 160 and 180 degrees with respect to the coplanar portions of the paper clip 101 comprising the upper portion of the legs 11, 16, and 18, bottom inner curve or partial oval loop 26, and outer top curved portion or partial oval loop 30 in order to facilitate sliding sheets in between the inner loop 34 and outer loop 32.

In a third preferred embodiment of a paper clip 102 is shown in FIGS. 16-20, the free distal end 12 of the leg forming a portion of the outer loop is bent at a selected angle 23 forming a distal section or prong 112 extending outwardly which can be pulled over to cooperatively engage hook 22 at angle 23 providing a releasable fastener demonstrating a stronger locking mechanism. which are normally spread apart at rest due to the memory and tensile strength of the wire. The distal ends of the legs 18 and 20 are normally spread apart at rest due to the memory and tensile strength of the wire. The angled portion or prong 112 of the leg 18 of the outer loop provides a handle for or grip for pulling the straight portion 18 into the hook 22 for creating a releasable fastener and for locking purposes providing a more positive hooking action.

In the third embodiment, the distal end portion 7 is bent at an acute angle forming a hook 22 bent at an angle of less than 180 degrees and more preferably bent outwardly an angle of about 90 degrees and more preferably at an acute angle of up to 60 degrees, and more preferably up to 45 degrees, typically in a range of from 30 to 60 degrees. The hook can be formed by simply forming an angle or as shown in the FIGS. 16-20 the hook 7 can bent to form a curve wherein the distal end portion 7 is bent outwardly at an angle of about 90 degrees with the tip 35 being bent downwardly at a selected angle of less than 90 degrees. The hook 22 is twisted and/or offset at a slight angle so that it is not coplanar with the legs 11, 18, and 16. The wire is made of a spring type material with memory in order for legs 18 and 20 can be temporarily bent or biased at an angle with respect to the bottom portion of the loop 24 for cooperative engagement wherein the tension and tensile strength of the wire holds the distal leg portion 12 securely and releasably engaging the hook 7.

As best illustrated in FIGS. 9-16, the paper clip embodiment 102 includes a distal end 12 of leg 18 bent at a selected angle 23 outwardly at a selected angle of less than 180 degrees and preferably at about a right angle of 90 degrees in order for the tip to point outward providing a outer loop leg projection or prong 112 for more secure engagement with the hook 22. The projection 112 of leg 18 is spring biased in close proximity to the hook 22 wherein the projection 112 cooperatively engages the hook 22 securing the corner of sheets therebetween even when the pages are folded over the paper clip.

The free end 22 of straight portion 20 is bent at a right angle pointing outward from partial oval loop 34 and extending upward from the plane containing partial oval loops 32 and 34. It will be seen that the free end 22 forms a hook which will be used to lock the paper clip by holding the longitudinal portion 18 over the dog-eared pages.

Moreover, as shown in FIG. 15, the outer bottom curved portion or partial oval loop 24 of the embodiments shown in FIGS. 16-20 may be bent at a slight obtuse angle 5 at upward or downward at slightly less than 180 degrees and preferably between 160 and 180 degrees with respect to the coplanar portions of the paper clip 101 comprising the upper portion of the legs 11, 16, and 18, bottom inner curve or partial oval loop 26, and outer top curved portion or partial oval loop 30 in order to facilitate sliding sheets in between the inner loop 34 and outer loop 32.

Figure 13:
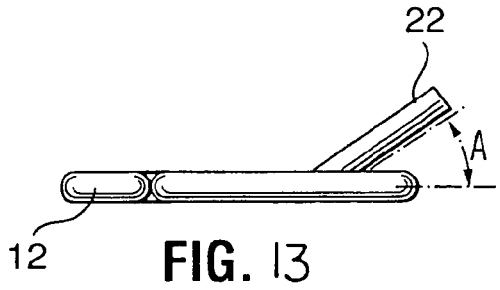
FIG. 13 is an end view of the paper clip of FIG. 8, showing the hook extending from the inner leg.
Figure 14:
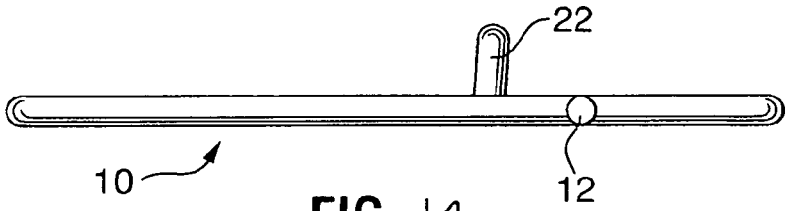
FIG. 14 is a side view of the paper clip of FIG. 8, showing distal end of the inner leg forming the hook member.

In a fourth preferred embodiment the gaper clip 103 is best illustrated in FIGS. 21-25 the distal end portion 7 is bent outwardly at a selected angle 21 of less than 180 degrees and preferably about 90 degrees forming a projection or prong 8 extending at an angle of less than 180 degrees and more preferably at an angle up to 90 degrees. The projection 8 may be twisted and/or offset at a slight angle so that it is not coplanar with the legs 11, 18, and 16 as shown in FIG. 13. The free distal straight end 12 of leg 18 can be bent outwardly at an angle to form a tab or holding means and configured in a circle, oval, triangle or other geometric or fanciful shape extending outward from the long partial oval loop 32 so that the free end 12 is coplanar with the two partial oval loops 32 and 34. Due to the tensile strength of the wire, the distal end 12 of leg 18 is spring biased and cooperatively engages the projection 8 of inner leg 20 securing the corner of sheets therebetween even when the pages are folded over the paper clip. The distal end 12 as shown in the figures includes a means for holding or tab 50 which as shown comprises a coil or loop 50 extending from the distal end 12 of leg 18 for providing a holding means presenting a better grip for biasing leg 18 in cooperative engagement with the prong 8 extending from the distal end 7 of leg 20.

The free end 12 of straight portion 20 is bent in a coil extending outwardly from partial oval loop 34 and, as shown in FIG. 6, extending upward from the plane containing partial oval loops 32 and 34. It will be seen that the free end 8 forms a prong which cooperatively engages the outer loop leg 18 to removably fasten and lock the paper clip by holding the longitudinal portion 18 over the dog-eared pages 110.

Moreover, as shown in FIG. 15, the outer bottom curved portion or partial oval loop 24 of the embodiments shown in FIGS. 21-25 may be bent at a slight obtuse angle 5 at upward or downward at slightly less than 180 degrees and preferably between 160 and 180 degrees with respect to the coplanar portions of the paper clip 101 comprising the upper portion of the legs 11, 16, and 18, bottom inner curve or partial oval loop 26, and outer top curved portion or partial oval loop 30 in order to facilitate sliding sheets in between the inner loop 34 and outer loop 32.

As shown in the figures, the method of using the paper clip comprises, consists of or consists essentially of the steps of applying the paper clip to a number of pages near one corner by sliding the short partial oval loop 34 over the top edge 102 of the sheets "pages" 100 and the long partial oval loop 32 under the top edge 102 of the sheets 100. Moving or sliding the sheets between the loops 34 and 32 of the paper clip 10 to a point where the straight leg portion 14 forms a 45° angle with the adjacent side edges 104 of the pages 100 at the corner 106 of the pages and where the outer bottom curved portion 24 of the outer loop 4 and the outer top curved portion 30 of outer loop 32 are adjacent the top edge 102 and the side edge 104 respectively of the pages 100. Bending the corners 106 of the pages over the straight leg portion 14 to form a dog-ear 110. Tucking the corners 106 the dog-ears 110 under the straight leg portion 20, and pulling the straight leg portion 18 across and over the hook 22 cooperatively engaging same allowing the hook 22 to removably secure the straight leg portion 18 whereby the free distal end 12 of leg 18 hooks in to the free distal end of the leg 20 forming the hook 22.

In the configuration shown and described above, the tips of the dog-ears are securely held between the two straight portions 18 and 20 and the straight portion 16 under the pages. The dog-eared pages are wrapped tightly around the straight portion 14.

To remove the paper clip, unhook the straight portion 18 from the tip 22 of the straight portion 20, raise the tips of the pages from under the straight portion 20 and slide the paper clip off the pages.

Figure 26:
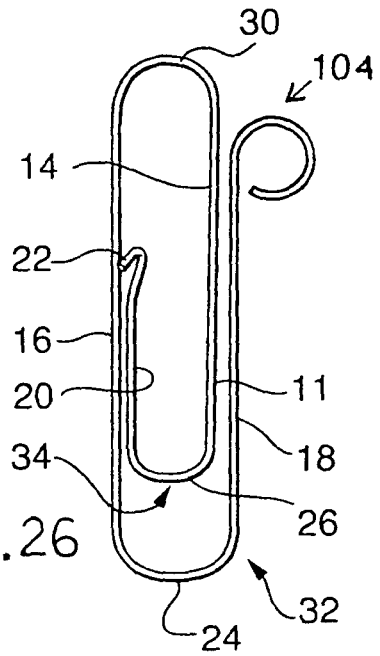
FIG. 26 is a front view of a fifth embodiment of the paper clip providing a fastening means defining a projection curved forming a hook for cooperatively engaging a free distal end of the leg of the outer loop which includes an outer loop distal leg tab means for cooperative engagement with extending above the inner loop leg hook when in a closed fastened position.

In a fifth preferred embodiment the paper clip 104 as illustrated in FIG. 26, the distal end portion 7 of inner leg 11 is bent at an acute angle forming a hook 22 bent at an angle of less than 180 degrees and more preferably bent outwardly an angle of about 90 degrees and more preferably at an acute angle of up to 60 degrees, and more preferably up to 45 degrees, typically in a range of from 30 to 60 degrees. The hook can be formed by simply forming an angle or the hook 22 can bent to form a curve wherein the distal end portion 7 is bent outwardly at an angle of about 90 degrees with the tip 35 being bent downwardly at a selected angle of less than 90 degrees. The hook 22 is twisted and/or offset at a slight angle so that it is not coplanar with the legs 11, 18, and 16. The wire is made of a spring type material with memory in order for legs 18 and 20 can be temporarily bent or biased at an angle with respect to the bottom portion of the loop 24 for cooperative engagement wherein the tension and tensile strength of the wire holds the distal leg portion 12 securely and releasably engaging the hook 7.

The distal end portion 7 is bent outwardly at a selected angle 21 of less than 180 degrees and preferably about 90 degrees forming a projection or prong 8 extending at an angle of less than 180 degrees and more preferably at an angle up to 90 degrees. The projection 8 may be twisted and/or offset at a slight angle so that it is not coplanar with the legs 11, 18, and 16 as shown in FIG. 13. The free distal straight end 12 of leg 18 can be bent outwardly at an angle to form a tab 50 or holding means and configured in a circle, oval, triangle or other geometric or fanciful shape extending outward from the long partial oval loop 32 so that the free end 12 is coplanar with the two partial oval loops 32 and 34. Due to the tensile strength of the wire, the distal end 12 of leg 18 is spring biased and cooperatively engages the projection 8 of inner leg 20 securing the corner of sheets therebetween even when the pages are folded over the paper clip. The distal end 12 as shown in the figures includes a means for holding or tab 50 which as shown comprises a coil or loop 50 extending from the distal end 12 of leg 18 for providing a holding means presenting a better grip for biasing leg 18 in cooperative engagement with the prong 8 extending from the distal end 7 of leg 20.

The free end 12 of straight portion 20 is bent in a coil extending outwardly from partial oval loop 34 and, as shown in FIG. 6, extending upward from the plane containing partial oval loops 32 and 34. It will be seen that the free end 8 forms a prong which cooperatively engages the outer loop leg 18 to removably fasten and lock the paper clip by holding the longitudinal portion 18 over the dog-eared pages 110.

Moreover, as shown in FIG. 15, the outer bottom curved portion or partial oval loop 24 of the embodiments shown in FIG. 26 may be bent at a slight obtuse angle 5 at upward or downward at slightly less than 180 degrees and preferably between 160 and 180 degrees with respect to the coplanar portions of the paper clip 101 comprising the upper portion of the legs 11, 16, and 18, bottom inner curve or partial oval loop 26, and outer top curved portion or partial oval loop 30 in order to facilitate sliding sheets in between the inner loop 34 and outer loop 32.

As shown in the figures, the method of using the paper clip comprises, consists of or consists essentially of the steps of applying the paper clip to a number of pages near one corner by sliding the short partial oval loop 34 over the top edge 102 of the sheets "pages" 100 and the long partial oval loop 32 under the top edge 102 of the sheets 100. Moving or sliding the sheets between the loops 34 and 32 of the paper clip 10 to a point where the straight leg portion 14 forms a 45° angle with the adjacent side edges 104 of the pages 100 at the corner 106 of the pages and where the outer bottom curved portion 24 of the outer loop 4 and the outer top curved portion 30 of outer loop 32 are adjacent the top edge 102 and the side edge 104 respectively of the pages 100. Bending the corners 106 of the pages over the straight leg portion 14 to form a dog-ear 110. Tucking the corners 106 the dog-ears 110 under the straight leg portion 20, and pulling the straight leg portion 18 across and over the hook 22 cooperatively engaging same allowing the hook 22 to removably secure the straight leg portion 18 whereby the free distal end 12 of leg 18 hooks in to the free distal end of the leg 20 forming the hook 22.

In the configuration shown and described above, the tips of the dog-ears are securely held between the two straight portions 18 and 20 and the straight portion 16 under the pages. The dog-eared pages are wrapped tightly around the straight portion 14.

To remove the paper clip, unhook the straight portion 18 from the tip 22 of the straight portion 20, raise the tips of the pages from under the straight portion 20 and slide the paper clip off the pages.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A paper clip comprising:

a length of a wire bent to form an oval loop with a first free end and a second free end comprising a partial outer oval loop and a partial inner oval loop disposed within said partial outer oval loop, said partial outer oval loop and said partial inner oval loop being generally coplanar with one another;

said partial outer oval loop is concentric with said partial inner oval loop;

said partial outer oval loop including an outer straight portion with said first free end forming a first U-shaped bottom portion connecting to a second straight portion connecting to a third straight portion by a second inverse U-shaped portion;

a fourth straight portion connecting to said third straight portion by a third inverse "U-shaped" portion; and a fifth segment including a second free end extending outwardly and across said second straight portion at an angle; wherein said fifth segment can be biased inwardly whereby said second free end can engage said first straight portion securely holding a sheet of material therebetween; and a distal end segment extending from said outer straight portion at an angle between said first free end and said first U-shaped bottom portion for cooperatively interlocking and releasably engaging said fifth segment at an intersection of said fifth segment and said sixth segment.

2. A method of using the paper clip of claim 1 comprising the steps of:

applying said paper clip to a number of pages near a selected corner with said first partial oval loop on a top surface of a stack of pages and said second partial oval loop under a bottom surface of said stack of pages;

moving said paper clip to a point where said third straight portion forms a 45° angle with adjacent edges of said pages at said selected corner of said pages and where said first 180° bend and said second 180° bend are located near said edges of said pages;

bending said corners of said pages over said third straight portion to form a dog-ear;

tucking said tip of said dog-ears under said fourth straight portion; and pulling said first straight portion across and over said second free end bent at a right angle and allowing said second free end bent at a right angle to hold said first straight portion in a locked condition.

3. A paper clip consisting of:

a length of a wire bent to form an oval loop with a first free end and a second free end having an outer oval loop and an inner oval loop disposed within said outer oval loop, said outer oval loop and said inner oval loop being generally coplanar with one another;

said outer oval loop is concentric with said inner oval loop;

said outer oval loop including an outer straight portion with said first free end forming a first U-shaped bottom portion connecting to a second straight portion connecting to a third straight portion by a second inverse U-shaped portion;

a fourth straight portion connecting to said third straight portion by a third inverse U-shaped portion; and a fifth segment including a second free end extending outwardly and across said second straight portion;

wherein said segment can be biased inwardly whereby said second free end can engage said first straight portion securely holding a sheet of material therebetween; and a distal end segment extending from said outer straight portion at an angle between said first free end and said first U-shaped bottom portion for cooperatively interlocking and releasably engaging said fifth segment at an intersection of said fifth segment and said sixth segment.

4. The paper clip of claim 1, wherein said length of wire comprises a spring material with memory made of polymer, steel, aluminum, copper, plastic, copper, and combinations thereof.

5. The paper clip of claim 1, wherein said wire includes grooves, dimples, crimps, ridges, undulations, striations, smooth rectilinear sections, and combinations thereof.

6. The paper clip of claim 1, wherein said second free end is bent at a right angle.

7. The paper clip of claim 1, wherein said second free end is bent at an angle of between 30 and 60 degrees.

8. The paper clip of claim 1, wherein said second free end is bent at an angle of less than 180 degrees.

9. The paper clip of claim 1, wherein said second free end forms a hook.

10. The paper clip of claim 1, wherein said fourth straight portion includes an obtuse angle near a distal end proximate said second free end forming a hook.

11. The paper clip of claim 1, wherein said angle between said fifth segment and said sixth segment is bent at an angle of less than 180 degrees.

12. The paper clip of claim 1, wherein said angle between said fifth segment and said sixth segment is bent at a right angle.

13. The paper clip of claim 1, wherein said angle between said fifth segment and said sixth segment is bent at an angle of between 30 and 60 degrees.

14. The paper clip of claim 1, wherein said first free end forms a hook.

15. The paper clip of claim 1, wherein said first free end forms a loop.

16. The paper clip of claim 1, wherein said fourth straight portion includes an obtuse angle near a distal end proximate said second free end forming a hook and said angle between said fifth segment and said sixth segment is bent at a right angle.

17. The paper clip of claim 1, wherein said fourth straight portion includes an obtuse angle near a distal end proximate said second free end forming a hook and said angle between said fifth segment and said sixth segment forms a loop.

18. The paper clip of claim 1, said second free end forming a hook and said angle between said fifth segment and said sixth segment is bent at a right angle.

19. The paper clip of claim 1, wherein said second free end is bent at a right angle and said angle between said fifth segment and said sixth segment forms a loop.

* * * * *